US005201786A

United States Patent [19]

Larsen

[11] Patent Number: 5,201,786

[45] Date of Patent: Apr. 13, 1993

[54] PREFABRICATED BUILDING

[76] Inventor: Peter W. Larsen, Residence Quatre Soleils, CH-3974 Mollens, Switzerland

[21] Appl. No.: 679,007

[22] PCT Filed: Sep. 26, 1989

[86] PCT No.: PCT/GB89/01128

§ 371 Date: May 1, 1991

§ 102(e) Date: May 1, 1991

[87] PCT Pub. No.: WO90/03475

PCT Pub. Date: Apr. 5, 1990

[30] Foreign Application Priority Data

Sep. 26, 1988 [GB] United Kingdom ..... 8822562

[51] Int. Cl.[5] ..... E04B 1/99; E06B 1/00

[52] U.S. Cl. ..... 52/227; 52/243

[58] Field of Search ..... 52/227, 233, 238.1, 52/239, 243, 300; 403/373, 388

[56] References Cited

U.S. PATENT DOCUMENTS

| | | | |
|---|---|---|---|
| 2,048,642 | 7/1936 | Venzie | 52/243 |
| 2,874,812 | 2/1959 | Clevett, Jr. | 52/227 |
| 2,883,852 | 4/1959 | Midby | 72/1 |
| 2,904,849 | 9/1959 | Bergstrom | 52/79.5 |
| 3,274,741 | 9/1966 | Neagle | 52/243 |
| 3,289,368 | 12/1966 | Mark | 52/239 |
| 3,334,455 | 8/1967 | Russell | 52/227 |
| 3,949,827 | 4/1976 | Witherspoon | 52/239 |
| 4,140,416 | 2/1979 | Parisien | 52/243 |
| 4,567,699 | 2/1986 | McClellan | 52/300 |
| 4,640,412 | 2/1987 | Skvaril | 52/79.5 |
| 4,733,512 | 3/1988 | Kiselewski | 52/238.1 |
| 4,757,656 | 7/1988 | Powers, Jr. | 52/300 |
| 5,069,263 | 12/1991 | Edwards | 52/239 |

FOREIGN PATENT DOCUMENTS

| | | | |
|---|---|---|---|
| 2519841 | 11/1975 | Fed. Rep. of Germany | 52/79.5 |

*Primary Examiner*—Richard E. Chilcot, Jr.
*Assistant Examiner*—Michele A. VanPatten
*Attorney, Agent, or Firm*—Ostrolenk, Faber, Gerb & Soffen

[57] ABSTRACT

A portable building may be assembled from kit comprising portable wall frames (2) and a portable foundation to which the wall frames can be secured. The foundation comprises corner pieces (31, 79) for determining accurately the configuration of each corner of the building and a plurality of continuous or sectioned beams (9) each of which defines the base of an external wall of the building and which are attached to the ground by means (20), and there are first securing means for securing each beam to its associated corner piece comprising slot (27) and ridge (32) that are formed one on the beam and the other on the corner piece, and mating substantially horizontal surfaces on each side of the ridge and slot, and there are second securing means for rigidly securing each wall frame to the upper surface of the beam comprising ridge (16) and slot (5), one being on the upper surface of the beam and the other on the downwardly facing surface of the wall frame, and mating substantially horizontal surfaces (14, 15) on each side of the ridge and slot, and each ridge has inclined sides for promoting insertion into its respective slot.

17 Claims, 5 Drawing Sheets

PREFABRICATED BUILDING

The present invention relates to a prefabricated building, which comprises a portable foundation which is suitable for placing onto relatively uneven ground.

It is well known to assemble buildings from a kit comprising a portable foundation which can be secured to the ground, and portable wallframes to define substantially the entire peripheral wall and which can be secured to the foundation.

Unfortunately existingly portable buildings tend to be difficult to assemble due to deviations in the portable foundation and/or in the positioning of the wall frames to the foundation.

According to the invention, in such a kit the portable foundation comprises corner pieces which each comprise arms fixed at an angle to one another for determining accurately the configuration of each corner of the building, a plurality of continuous or sectioned beams each of which defines the base of one external wall of the building, and means for attaching the beams to the ground, and the kit includes first securing means for rigidly securing each beam to its associated corner pieces, and second securing means for rigidly securing each wall frame onto the upper surface of its beam, in which the first securing means comprise a cooperating slot and ridge extending in the longitudinal direction of the beam and of the associated corner piece arm, one of the slot and ridge being formed on the beam and the other of the slot and ridge being formed on the arm of the corner piece, and the securing means also comprises mating substantially horizontal surfaces on each side of each of the ridge and slot, and in which the second securing means comprises a cooperating ridge and slot extending in the longitudinal direction of the beam and wall frame, one of the slot and ridge being formed on the upwardly facing surface of the beam and the other of the slot or ridge being formed on the downwardly facing surface of the wall frame, and the securing means also comprises mating substantially horizontal surfaces on each side of each of the ridge and slot, and each said ridge has inclined sides for promoting insertion into its respective slot characterised in that the beam is box-shaped in cross-section.

Although the slot of any or each of the securing means may simply comprise an opening sufficiently wide to receive the ridge, for instance having a width equal or very slightly larger than the width of the base (ie the widest part) of the ridge, some (and preferably all) of the slots are in the form of a groove which has inclined sides for mating with the inclined sides of the ridge. This promotes alignment of the respective components For maximum stability the sides of the ridge and slot are each inclined at an angle in the range 10° to 45° to the vertical, preferably around 12° to 20°, for instance about 15°.

Preferably the second securing means comprises a ridge formed on the beam and a slot formed in the wall frame. One advantage of this embodiment is that a ridge on a beam is less likely to be damaged during transport of the kit than a ridge on a wall frame.

Each securing means generally also comprises bolt means or other means for applying compression to the components of each securing means. The resultant compression between the mating substantially horizontal surfaces increases stability and the ridge/slot arrangement ensures accuracy of assembly.

A beam between two corner pieces may be a continuous beam, generally made as a single piece, or may be a sectioned beam. Thus it may comprise a plurality of beam sections that are fitted together (either in the kit or when assembling the building from the kit) so that they function as a beam. Generally a beam section is in the range 2 to 12 m, for instance about 6 m long. When a beam is required to be longer than the longest beam section, eg more than 6 m long, two or more beam sections are used to form a beam. The beam is usually in the range 5 to 15, for instance 8 to 10 cm wide and about the same height. Preferably the rigidity of each beam is such that when it is supported substantially horizontally at each end and has a weight having a mass of between 0.5 to 5 times the mass of the respective wall positioned midway along the length of the beam, the deflection of the beam is less than 1 mm.

The beam or beam assembly can have a rigidity such that when a weight having a mass 5 times the mass of the wall is placed as defined above the deflection is less than 1 mm. When heavier masses are are so placed then the deflection can be greater than 1 mm since it is unnecessary for the beam to be any more rigid. Furthermore the beam should be portable and so it is necessary for the beam (or the beam sections from which it is formed) to be sufficiently lightweight to achieve that purpose. The rigidity of the beam allows the building to be constructed and supported on a relatively uneven surface, whilst ensuring that the portable foundation remains true for supporting the wall. The beams are preferably formed from metal, in order to be sufficiently strong to meet these requirements.

The wall frames preferably define the entire peripheral wall of the building, as otherwise additional wall or support elements are required and this is less convenient. The wall frames (or at least one of them) may be empty, that is define an empty space. In this embodiment separate sheets may be supplied to be placed across the frame to form the wall. Usually however, the wallframes surround and can be securely fixed to a panel which fills the area within the frame. In this preferred embodiment the wall frames are supplied to the assembly site as preformed panels. In order to be portable walls usually comprise a plurality of wall panels. The panels preferably extend the whole height of the wall but less than the length of the wall and are placed adjacent to one another to form an entire wall. The panels may be provided with doors and/or windows as desired, either prefitted in the panels or for fixtures on assembly of the building. The panels are, for instance, about 2–2.5 m high and 0.6–1.5 m, preferably about 1.2 m wide, and about the same thickness as the foundation beams.

The rigidity of the beams, (for instance as set out above) preferably is such that to ensure that the panels of a wall which comprises of plurality of wall panels fit closely together when supported on the foundation, even when the foundation is based on relatively uneven ground and may thus be supported for instance only at each end. The beams may have to be sufficiently strong to support the weight of the second floor although the buildings formed from the present kits are generally single floor buildings.

The beam is box-shaped in cross-sectional. It may have outwardly extending flanges through which it is fixed to the ground or to other components, but preferably it is fixed to the ground via inwardly extending horizontal surfaces.

The corner piece can be U section, L section or even box section, but is most conveniently plate, usually for positioning horizontally generally under the ends of the respective beams. The plate thus preferably has an upwardly extending ridge for cooperating with downwardly facing slots in each of the associated beams. The corners are preferably, but not necessarily, right angled corners and the corner plate therefore preferably has two ridges mutually at right angles. The corner piece defines the angle that is to exist between adjacent corner wall sections by the angle between its arms. The corner piece may be, for example, square in horizontal section in which event it may be considered as being formed of two overlapping arms that provide, for instane, two ridges at right angles. Generally each corner piece is L, T or X shaped in horizontal cross section.

When a beam consists of two or more beam sections, they may be joined together by joining pieces, for instance L, U or plate-section joints, or box-section joints having a sliding fit with the beams. Such joints should be sufficiently strong to impart on the beam the rigidity characteristic preferred in the present invention.

The portable foundation preferably comprises also internal wall beams. These may be connected to the external beams by T-pieces, for instance being of U, L, box or, preferably, plate-section, for securing the internal beam to the external beam. The T-piece, as the corner piece, has securing means for securing to the external wall beam and separate securing means for securing to the internal wall beam.

When the building is constructed, the corner pieces are secured to the beams so that the beams are substantially prevented from moving relative to the corner pieces in a longitudinal direction (with respect to the beam). Preferably also the corner pieces are secured to the beams so that the beams are prevented from twisting about their longitudinal axis. This latter provision prevents the walls, as far as possible, from being deflected out of their respective vertical planes.

The walls may comprise wall corner units, for instance which abut the end frames of adjacent walls. A corner unit has securing means for securing it to the respective corner piece of the foundation and/or to the respective beams of the foundation. The securing means preferably comprise cooperating slots and ridges on the components with mating horizontal surfaces on each side of the slot and ridge, ie of the same type of the aforementioned securing means. The corner unit may aid the securing of the beams to the corner piece to help accurate configuration of the corner of the building and to help prevent the beams from being able to twist about their longitudinal axis.

Preferably the wall panels and any wall corner units are provided with securing means along their abutting sides. These securing means for instance comprise interlocking ridges and slots or grooves.

In any of the above mentioned securing means comprising cooperating ridge and slot, the ridge may be formed directly on the respective component. In some cases, however, and in particular in securing means provided between similar components, for instance, between two wall frames or between a wall frame and a corner unit, the ridge may be provided by an elongate member that can be so positioned relative to the component that it acts as a ridge on that component. Thus the components may be flat along the respective surface or it may have a groove eg one with inclined sides, that is formed directly in its surface and the elongate member may be shaped so that it cooperates with that surface and protrudes to provide a ridge with the required inclined sides. An elongate member for fixing between wall frames or between a wall frame and a corner unit can conveniently be provided with a longitudinal bore for reception of a bolt for fixing to the beam, thereby securing the wall frame and/or corner unit to the respective beam.

By providing such elongate members to create a ridge for securing means for abutting wall frames it is possible for all wall frames to have a groove formed directly in their component on each side of its perimeter. This facilitates manufacture and has the result that the securing means are more resistant to damage during production and transportation than a similar wall panel having a ridge formed on its frame. A groove in the top surface of the wall frame allows adjacent frames to be aligned and to be aligned with any corner units by the provision of a further elongate member and is shaped to cooperate with the respective grooves. Likewise, gaskets can be inserted in those top grooves.

An appropriately shaped elongate member ;may also be provided for fitting in the groove of the vertical edge of an internal wall frame where it meets another wall at a T-junction. That groove may also contain a gasket.

The kit generally also comprises roof supports that can be secured above the walls. These are provided with means for fixing them so as to be able to support the roof above the walls when there are fitted onto the foundation. Usually the roof supports are secured to the upper edges of the wall frames (which in a two storey house are, of course, the wall frames of the upper storey), either directly or by intermediate components. For instance the roof supports may comprise elongate struts which are fixable across the tops of the wall panels and corner units, optionally via horizontal roof beams. The fixing of the roof supports to the wall frames and/or of intermediate members to the wall frame or roof supports or both may be by interengaging ridges and slots, with adjacent mating horizontal surfaces, as described for the foundation.

The various securing means of the kit of the invention may be such as to provide permanent fixing of the components to each other, but are preferably such as to allow disassembly and reassembly of the building after the initial assembly. The securing means may comprise clips but preferably comprises bolts and, where necessary, respective nuts. The bolts may extend between the facing surfaces of the components to be secured or may extend through the entire component, for instance, may extend through the height of an entire wall panel to secure the panel to its respective beam.

The invention includes a building assembled from the kit. Although it is less convenient, part or all of the portable foundation, portable wall frames and first and second securing means may be supplied separately and the invention includes buildings erected from these parts even when not supplied in complete kit form.

Preferred embodiments of the various components of the kit are shown in the accompanying drawings in which.

Figure 1:
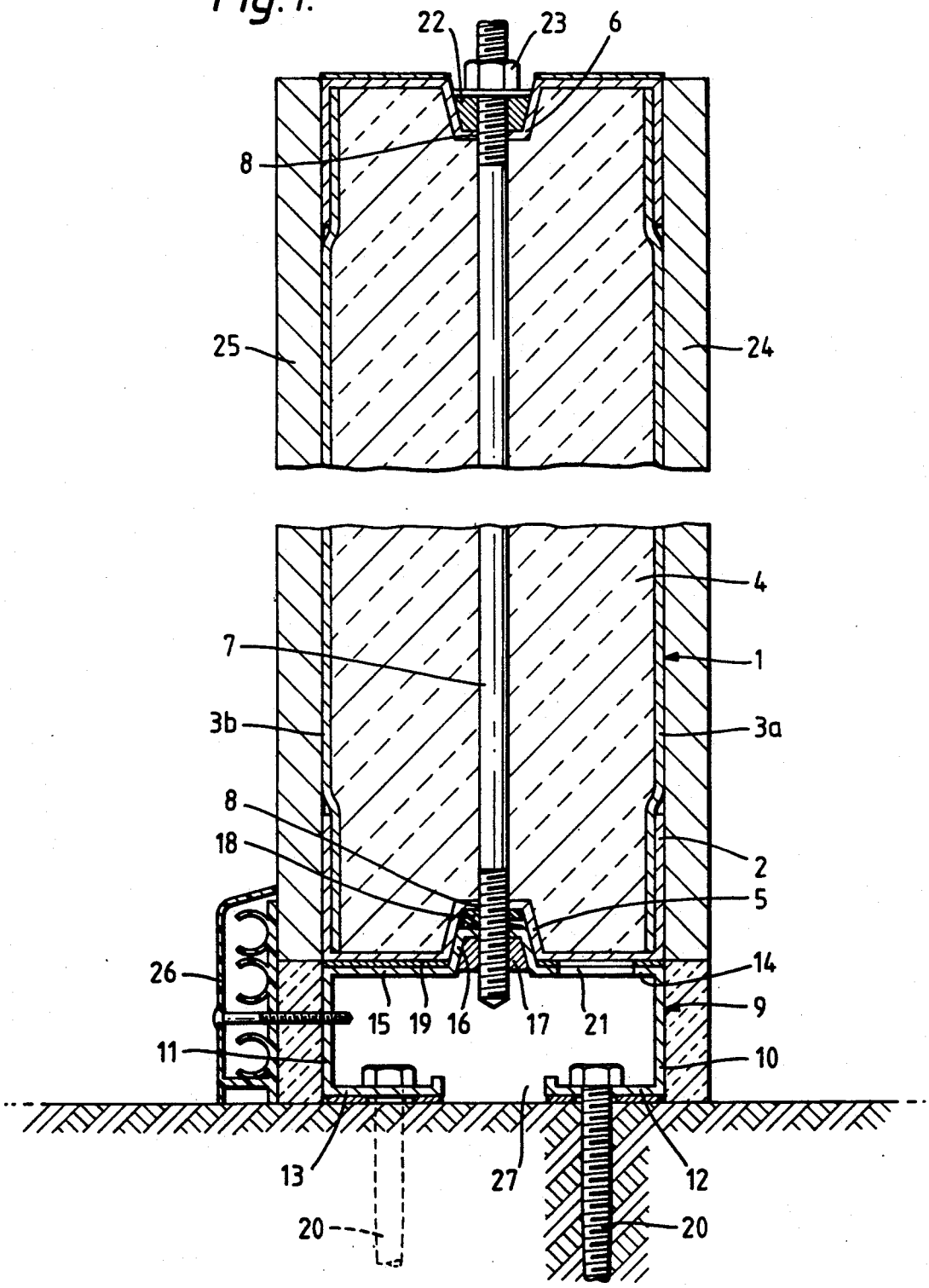
FIG. 1 is a vertical section through a wall panel and a beam.

Referring to FIG. 1, a wall panel 1 comprises a frame 2 surrounding internal and external sheets 3*a* and 3*b*, the gap between these sheets being filled by insulation 4 comprising, for instance, air, chemical foams, mineral wools, etc. The sheets and frame are preferably provided from steel, aluminium or another metal or alloy. They panel may be strengthened by the provision of horizontal, vertical or diagonal struts.

Along the lower edge of the frame there is a groove 5 extending longitudinally along the entire length of the frame. The groove has sides which slope at an angle of about 15° to the vertical. Along the upper edge of the frame there is provided a similar groove 6, again along the entire length of the frame. At intervals across the width of the panel there are provided bolts 7 which extend vertically right through the panel, and through apertures 8 in the top and bottom ridges.

The kit also comprises a beam 9 which is of a general box-section, that is it comprises vertical internal and external walls, 10 and 11, inwardly facing flanges along its lower surface, 12 and 13, and a top portion comprising horizontal surfaces 14 and 15 and a ridge 16 protruding upwardly from the top surface. The ridge extends along the entire length of the beam and is shaped and positioned so that it fits into the groove provided on the lower surface of the wall panel, so that the sides of the ridge and groove cooperate with one another. Furthermore the ridge and groove are provided so that the horizontal surfaces to the sides of the ridge and groove also cooperate with each other to provide further stability for the joint between the wall frame and the beam.

The bolt which passes through the wall panel also passes through the ridge in the beam and is secured by a nut 17. Between the upper edge of the ridge and the groove of the wall panel there is provided a gasket of an elastomeric material 18, which provides improved sound and heat insulation. There may also be provided filler materials 19 between the horizontal surfaces of the wall frame and adjacent beam.

The beam is secured to the ground via bolts 20 which can be inserted through the aperture 21 formed in the upper surface of the beam.

There is provided an elongate member 22 which is shaped to fit within the groove of the upper part of the wall panel. This is provided with openings through which the bolt 7 can be inserted. At its upper end the bold it tightened by a nut 23, which enables the wall panel to be tightly fixed to the beam.

After assembly of the kit decorative fascias 24 and 25 may be fixed to the wall surfaces and may provide decoration and/or additional insulation. To the external wall there is affixed a moulding 26 in which pipes or cables may be secured. Similar mouldings may be fixed to the internal wall.

Figure 2:
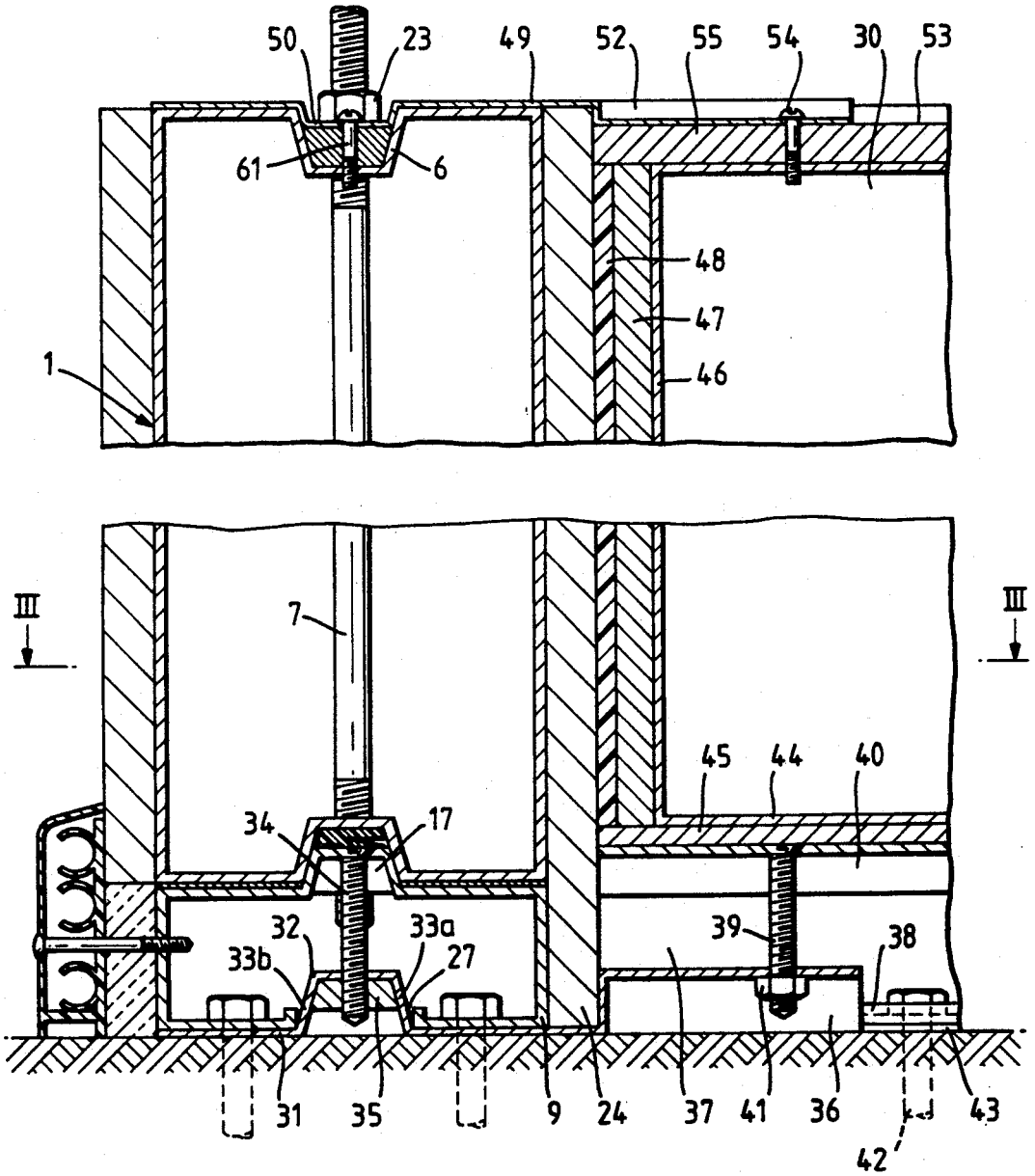
FIG. 2 is a vertical section through a perpendicular to the plane of an external wall panel passing through an internal wall meeting the external wall at a T junction.

In FIG. 2 there is shown a vertical section through a wall unit 1 (which for simplicity is illustrated as an integral frame and panel but which could comprise separate frame and sheets as in FIG. 1) and a beam 9, to which the wall unit is affixed via bolt 7 and nut 17 and 23. The section is also through an internal wall unit 30 which meets the external wall unit 1 at a T-junction. The foundation at this T-junction comprises a T-piece 31 which has securing means for securing to the beam 9. The securing means comprise a ridge 32 comprising sloping walls 33*a* and 33*b*, whose base is approximately the same width as the width of the slot 27 in the base of the beam. Instead of having a slot 27 the bottom wall of the beam could be provided with a groove similar to the grooves formed in the wall frame. The provision of a slot facilitates the insertion of nuts 17 before or upon assembly. The T-piece is secured to the beam by a plurality of screws 34 which pass through the upper surface of the ridge of the T-piece and into a nut 35 which fits under the ridge of the T-piece.

The plate which forms the T-piece is substantially flat so that it passes underneath the internal edge of the beam and the decorative fascia 24. Beyond those portions it has an upwardly extending ridge 36 which extends in a direction perpendicular to the ridge 32 which cooperates with the external beam. This perpendicular ridge 36 cooperates with a similar slot 38 in internal beam 37. The internal beam is affixed to the T-piece via a bolt 39 which passes through the upper surface of an upwardly extending ridge 36 on the T-piece and through a nut 41 which is underneath the ridge 36 in the T-piece. The beam 37 is secured to the ground via bolts 42. It may be necessary to provide support plates 43 between the ground and the beam to increase stability of the beam on the ground.

Figure 3:
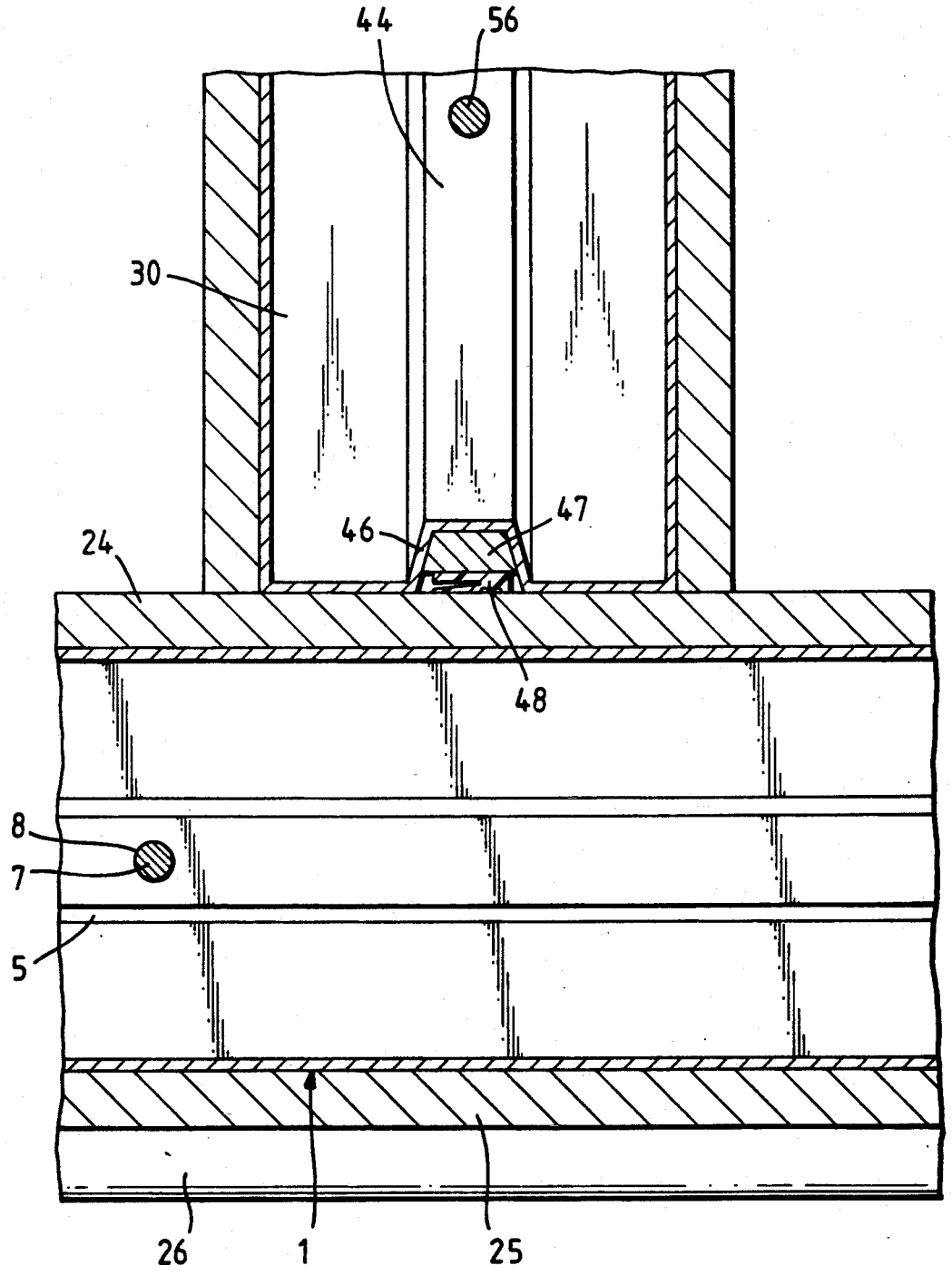
FIG. 3 is a horizontal section along line III—III of FIG. 2.

The internal wall unit 30 is supported on the internal beam 37 in a similar manner to the external walls. Thus the bottom part of the wall frame comprises a groove 44 which has sloping sides for cooperating with the ridge 40 on the beam. A gasket 45 is provided between the ridge 40 and the groove 44 to improve insulation. At the vertical side part of the wall unit 30 there is also provided a groove 46 of the identical profile to the groove at the lower part of the wall unit. This can more clearly be seen in the cross-section in FIG. 3. Into the groove there is fitted an elongate member 47 which is shaped to cooperate with the sloping sides of the grooves. Preferably it is substantially identical to the elongate member 22 which is fitted into the groove along the top part of the external wall unit shown in FIG. 1. In order to improve insulation between the walls there is additionally provided an elastomeric gasket 48, which is similar to gaskets 18 and 45.

At the top of the internal wall there is provided a top T-piece for affixing the upper portions of the external and internal walls. This T-piece 49 comprises a ridge 50 which is shaped to cooperate with the top groove 6 of the external wall and is affixed thereto via screws 51 which pass through the ridge and the groove. The T-piece also comprises a downwardly extending ridge 52 which is perpendicular to the external wall ridge and is similarly shaped to cooperate with the groove 53 formed in the upper part of the internal wall unit 30. The T-piece is attached to the wall unit via screws 54 passing through the ridge and groove. The space in the top groove 53 of the internal wall unit 30 is preferably filled by an elongate member 55 which is preferably substantially the same as elongate members 22 and 47. The external wall unit 1 is fixed to the beam via a bolt 7 which passes through the entire height of the wall unit. Likewise the internal wall unit 30 is affixed to the internal beam by a bolt 56 (FIG. 3) which again passes through the entire height of the wall unit.

Figure 4:
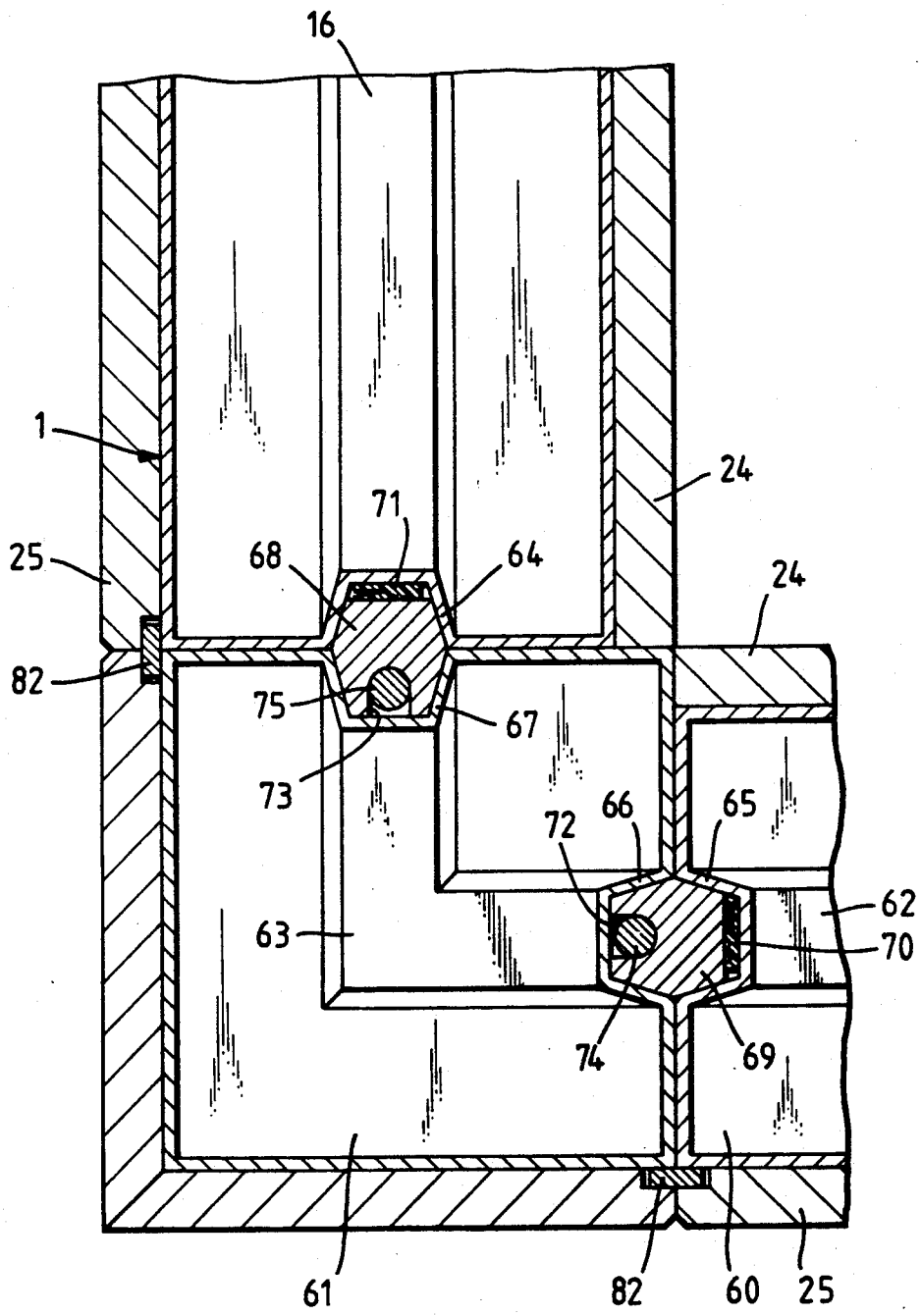
FIG. 4 is a horizontal section through two walls where they meet at a corner.

In FIG. 4 there is shown a horizontal section through two wall units meeting at a corner unit. Thus one external wall 1 meets a second external wall 60 and these are joined together by a wall corner unit 61. The wall frame have grooves in their lower portions 16 and 62 which cooperate with the associated beams of the foundation, which are further illustrated in FIG. 5 and described below. Likewise corner unit 61 has an L shaped groove in 63 in its lower end. This groove cooperates with the ridges in both of the beams which meet at the corner. Along the abutting sides of the wall units 1 and 60 and the corner units 61 there are provided grooves 64 to 67 of the same profile as the bottom groove. The kit comprises elongate members 68 and 69 which are cylinders of an appropriate section such that they fill the space between the grooves of the abutting wall and wall corner unit. To improve insulation there are provided gaskets 70 and 71 which fit within the groove. In elongate members 66 and 67 there are provided bores 72 and 73 for receiving long bolts 74 and 75 which extend throughout the height of the wall units and corner unit and so as to secure these to the beam below. In this embodiment the corner unit has larger horizontal dimensions than the thickness of the wall units in order to improve fitting of the internal decorative fascia panels 24. Strips 82 are adhered along the external joint between two wall panels to aid prevention of ingress of water or air.

Figure 5:
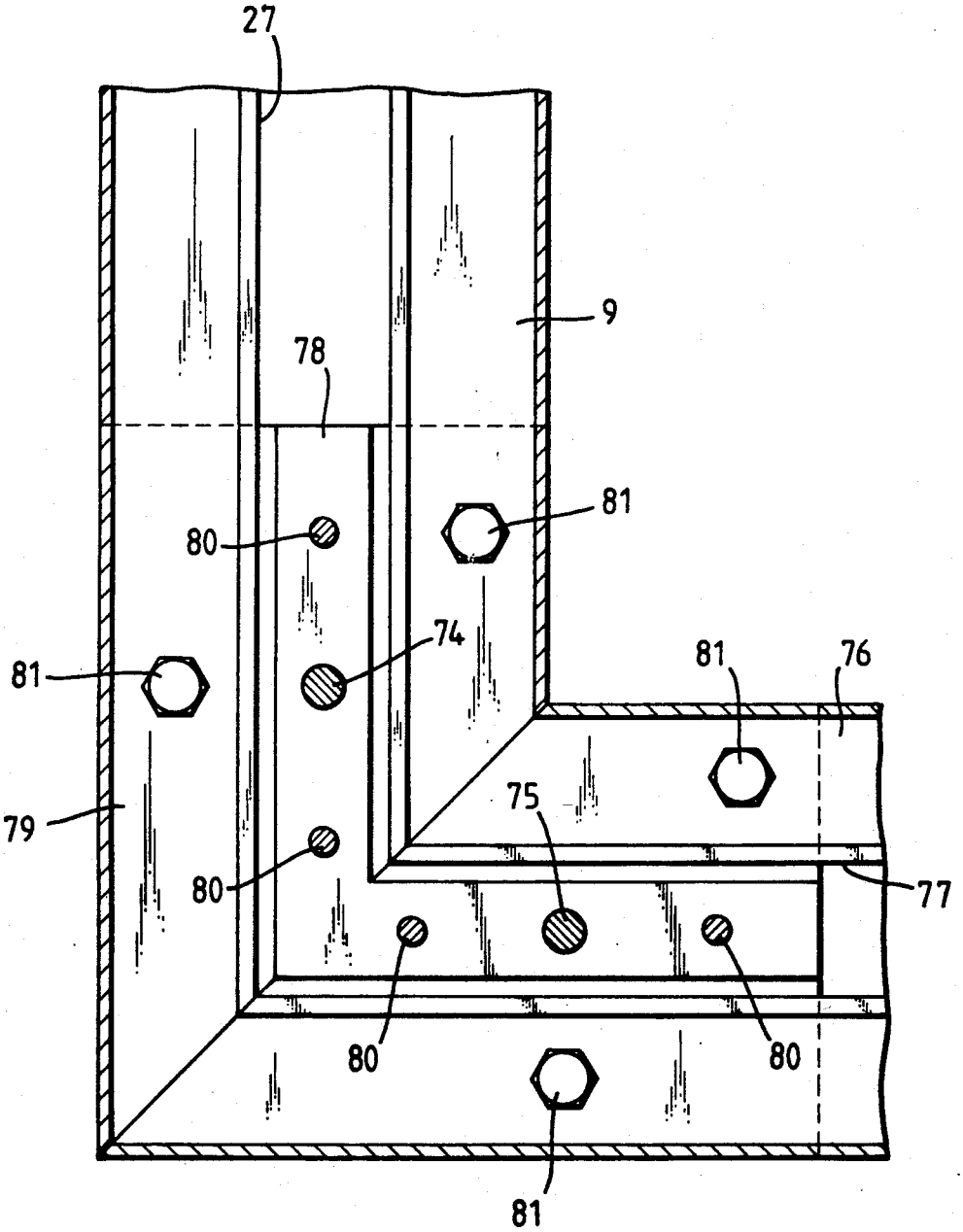
FIG. 5 is a horizontal section through two beams where they meet at a corner.

FIG. 5 shows a horizontal section through two beams where they meet at the corner below the walls of FIG. 4. The beams 9 and 76 each have slots 27 and 77, into which can fit the upwardly extending L shaped ridge 78 of a corner piece 79 having two arms at right angles. The beams are secured to the corner piece 79 by bolts 80. The corner piece 79 is fixed to the ground via bolts 81. There can also be seen in FIG. 5 the bolts 74 and 75 which pass through the elongate members between the wall units and the corner unit of FIG. 4. These bolts are held by nuts 17 (FIG. 1) which are secured underneath the inside of the ridge 16 (FIG. 1) in the upper surface of the beam.

The wall units, wall corner unit, beams and L- and T-corner pieces shown in the drawings may be made from steel usually lightweight steel or aluminium for instance 2.5 to 2.8 mm gauge steel. The sheets 3*a* and 3*b* from which the wall panels are completed, as they are not load bearing, may be made from the inner gauge metal less than 2 mm eg about 1 mm or 0.7 mm steel. The walls and beams of the building illustrated and about 10 cm thick. These components may be shaped by conventional sheet metal shaping processes or may be made by extruding the components. In order to ensure that the corners of the buildings are true and the walls are true verticals the components should be manufactured to tolerances of less than ±1 mm preferably about ±0.5 mm (by which is meant that the longest dimension of each component is manufactured to such tolerances).

The elongate members which fit within the grooves of the wall units may be made from for instance, plastics material such as made by injection moulding, such as polypropylene or relatively hard thermo plastic material. The elastomeric gaskets are made from natural or synthetic elastomeric materials, for instance comprising synthetic rubber or soft plastic materials.

The components in the kit in general have all the necessary holes for passage of screws and bolt preformed. This enables the building to be erected by unskilled people who simply screw and bolt the components together and to the ground in the appropriate order using the screws and nuts and bolts that preferably are included as part of the kit.

Preferably the kit is transported as a container unit as described in the application filed even date (Ser. No. 07/678,985) by the same applicant entitled Prefabricated Building Kit claiming priority from GB 8822561, the entire disclosure of which is herein incorporated by reference.

I claim:

1. An assembly for a building which comprises a portable foundation adapted to be placed on a ground and comprising a plurality of box-shaped cross-section beams each of which defines the base of an external wall of the building, a plurality of corner pieces each having arms fixed at an angle to one another for determining accurately each corner of a building, said arms being securable to two beams to thereby define such corner, means for attaching the beams to the ground, a plurality of portable wallframes which define substantially the entire external wall and are securable to the foundation, first securing means for rigidly securing each corner piece to its associated beam comprising a first cooperating slot and ridge extending in the longitudinal direction of such beam and of the associated corner piece arm, one of the first slot and ridge being formed on the beam and the other of the first slot and ridge being formed on the associated corner piece arm, each side of each of the first ridge and slot having mating substantially horizontal surfaces; and second securing means for rigidly securing each wallframe onto an upper surface of a beam comprising a second cooperating slot and ridge extending in the longitudinal direction of the beam and wallframe, one of the second slot and ridge being formed on an upwardly facing surface of the beam and the other of the second slot and ridge being formed on a downwardly facing surface of the wallframe, each of the second slot and ridge having on each side mating substantially horizontal surfaces, each said first and second ridges having inclined sides thereby promoting insertion into its respective slot.

2. The assembly according to claim 1 in which at least one of the first and second slots is in the form of a groove which has inclined sides for mating with the inclined sides of its corresponding ridge.

3. The assembly according to claim 2 in which the sides of each first and second slot and ridge are each inclined at an angle in the range 12° to 20° to the vertical.

4. The assembly according to claim 1 including bolt means for holding mating horizontal surfaces against one another under compression.

5. The assembly according to claim 1 in which the rigidity of each beam is such that when it is supported substantially horizontally at each end thereof and has a weight of 0.5–5 times the weight of a wallframe positioned midway along the length of the beam, the deflection of the beam is less than 1 mm.

6. The assembly according to claim 1 in which the first slot is formed on a downward facing surface of the beam.

7. The assembly according to claim 6 in which the corner piece is in the form of a plate which carries said first ridge upward extending therefrom.

8. The assembly according to claim 1 in which the corner pieces and beams are adapted to be secured together such that the beams are substantially prevented from moving relative to the corner pieces in a longitudinal direction (with respect to the beam) and the beams are prevented from twisting about their longitudinal axes.

9. The assembly according to claim 1 in which the wallframes include a plurality corner units each of which has securing means for securing the corner unit to at least one corner piece.

10. The assembly according to claim 9 in which the corner unit securing means comprises a third slot and ridge with mating horizontal surfaces on each side thereof.

11. The assembly according to claim 1 including a plurality of gaskets adapted to be positioned between cooperating ridges and slots.

12. The assembly according to claim 1 having roof supports with means for supporting a roof above the wallframes.

13. The assembly according to claim 1 in which the first and second securing means are adapted to allow disassembly and reassembly of a building.

14. The assembly according to claim 1 in which the second slot is formed on a downward facing surface of the wallframe.

15. The assembly according to claim 1 in which one of said first slot and ridge is formed on a downwardly facing surface of the corner piece and the other of the first slot and ridge is formed on an upwardly facing surface of a beam.

16. The assembly according to claim 15 in which the first slot is formed on a downwardly facing surface of the corner piece.

17. A building erected from the assembly according to claim 1.

* * * * *